US005722840A

United States Patent [19]

Auclair et al.

[11] Patent Number: 5,722,840

[45] Date of Patent: Mar. 3, 1998

[54] CONDUCTOR PROTECTOR

[75] Inventors: William T. Auclair, Winsted; John W. Auclair, Norfolk; Randolph L. Auclair, New Hartford, all of Conn.

[73] Assignee: Electric Motion Company, Inc., Winsted, Conn.

[21] Appl. No.: 692,602

[22] Filed: Aug. 6, 1996

Related U.S. Application Data

[60] Division of Ser. No. 395,453, Feb. 28, 1995, Pat. No. 5,597,314, which is a continuation-in-part of Ser. No. 58,159, May 5, 1993, Pat. No. 5,429,532.

[51] Int. Cl.[6] ..... H01R 13/648

[52] U.S. Cl. ..... 439/98; 439/793; 439/812

[58] Field of Search ..... 439/98–100, 793, 439/810–812, 814; 24/135 R, 135 N

[56] References Cited

U.S. PATENT DOCUMENTS 3,757,269 9/1973 Baumgartner et la. ..... 439/99
4,561,708 12/1985 Sorlien et al. ..... 439/99

*Primary Examiner*—Gary F. Paumen
*Attorney, Agent, or Firm*—Alix, Yale & Ristas, LLP

[57] ABSTRACT

A ground clamp for clamping to a cable shield to provide a ground connection employs a U-shaped yoke. A keeper has a driver which threadably engages thread surfaces at the interior side of the yoke legs. The keeper has a clamp jaw which may be compressively engaged against a cable shield received in an aperture defined by the yoke. A surface of the clamp jaw and a surface of the driver have complementary radially extending projections and grooves, respectively. The projections are received by the grooves when the clamp jaw engages the cable shield to resist relative movement between the driver and the clamp jaw. The yoke then connects to a common ground point via a flexible ground wire connection. A protective shoe may be inserted between the cable conductors and the clamp jaw to prevent crushing of the connectors.

14 Claims, 4 Drawing Sheets

CONDUCTOR PROTECTOR

CROSS REFERENCE TO RELATED APPLICATION

This application is a divisional of application Ser. No. 08/395,453, filed on Feb. 28, 1995, now U.S. Pat. No. 5,597,314 issued Jan. 28, 1997, which was a continuation-in-part of Ser. No. 08/058,159 filed on May 5, 1993, now U.S. Pat. No. 5,429,532 issued Jul. 4, 1995.

BACKGROUND OF THE INVENTION

This invention relates generally to devices for implementing a ground connection between a metallic shield of a cable and a common ground point. More particularly, the present invention relates generally to clamp devices which mount to service cables and connect via a flexible conductor with a common ground point.

A number of various types of devices have been employed for connecting a ground wire with the tubular ground shields of buried service wires. Most conventional devices employ clamp assemblies of various forms. In applications to which the present invention relates, the connecting devices are ordinarily positioned within a cabinet, housing or other enclosure, hereafter collectively termed "enclosure", to provide a grounding connection between the metallic shield of the service cable and a common ground point. Frequently, there is a minimal amount of available space within the enclosures for such ground connecting devices.

A number of conventional designs are configured to mount rigidly or semi-rigidly within the enclosures. For such designs, damage to the cables can occur when the enclosure is subject to intense environmental changes and the cables are fixedly positioned in the ground. For example, it is not uncommon for the enclosure to heave as a result of frost while the service cables are frozen in position in the ground.

U.S. Pat. No. 4,646,395 discloses one type of cable clamp to which the present invention generally relates. The clamp has a stamped metal body portion with two end walls that extend at right angles to the base. A pair of arms spaced intermediate along one edge of the base extend outwardly at essentially right angles to the base such that they are parallel to the end walls. An arm and an associated end wall form channels. A moveable jaw interfits below the arms. The jaw is tightenable into compressive engagement with the cables which are received in the channels.

SUMMARY OF THE INVENTION

Briefly stated, the invention in a preferred form is a cable shield ground clamp for connecting a service cable shield with a flexible ground conductor. The clamp assembly comprises a generally U-shaped yoke which defines a service cable receiving aperture. The legs of the yoke have opposed thread surfaces. A keeper is threadable with the thread surfaces of the yoke and torquable for displacement relative to the yoke. The keeper includes a clamp jaw which is compressively engageable against a service wire ground shield received in the aperture. The yoke includes a set screw or other means for connecting the yoke with a flexible ground wire or other ground connection.

The keeper has a rotatably mounted threaded driver which engages with the yoke. A slot in the bottom of the driver facilitates the threadable displacement of the keeper to implement the clamp connection. The keeper jaw, in one embodiment, has a V-shaped recess for intimately engaging the ground shield. The keeper has a pair of skirts which define opposed openings through which the legs of the yoke are received. The keeper also has a lock mechanism for resisting relative rotational movement between the threaded driver and the keeper clamp jaw when the clamp is installed on the cable. The lock mechanism comprises a surface of the threaded driver which engages a surface of the keeper clamp jaw as the clamp tightens. In one embodiment, the driver surface and the keeper clamp jaw surface have complementary serrated surfaces wherein projections on one surface are received by indentations in the other surface. This arrangement increases the ability of the clamp to resist loosening due to vibration or cyclical temperature changes.

A protective shoe may be inserted in the cable between the conductors and the keeper clamp jaw to prevent crushing of the inner conductors. The protective shoe is an elongated semi-sleeve-like or trough-like cap composed of electrically conductive material comprising inner and outer arcuate surfaces. A longitudinally extending channel allows the cable to be inserted into the protective shoe. A first end of the protective shoe is tapered to facilitate inserting the shoe between the conductors and the shield or between the shield and the outer insulation.

An object of the invention is to provide a new and improved cable shield ground clamp for implementing a ground connection between the metallic shield of a service cable and a common ground point.

Another object of the invention is to provide a new and improved cable shield ground clamp which is resistant to loosening due to vibration and cyclical temperature changes.

A further object of the invention is to provide a new and improved cable shield ground clamp which bonds with a shielded cable in a manner which provides superior mechanical strength and electrical conductivity without crushing the cable conductors.

Other objects and advantages of the invention will become apparent from the specification and the drawings.

DETAILED DESCRIPTION OF THE PREFERRED EMBODIMENT

Figure 1:
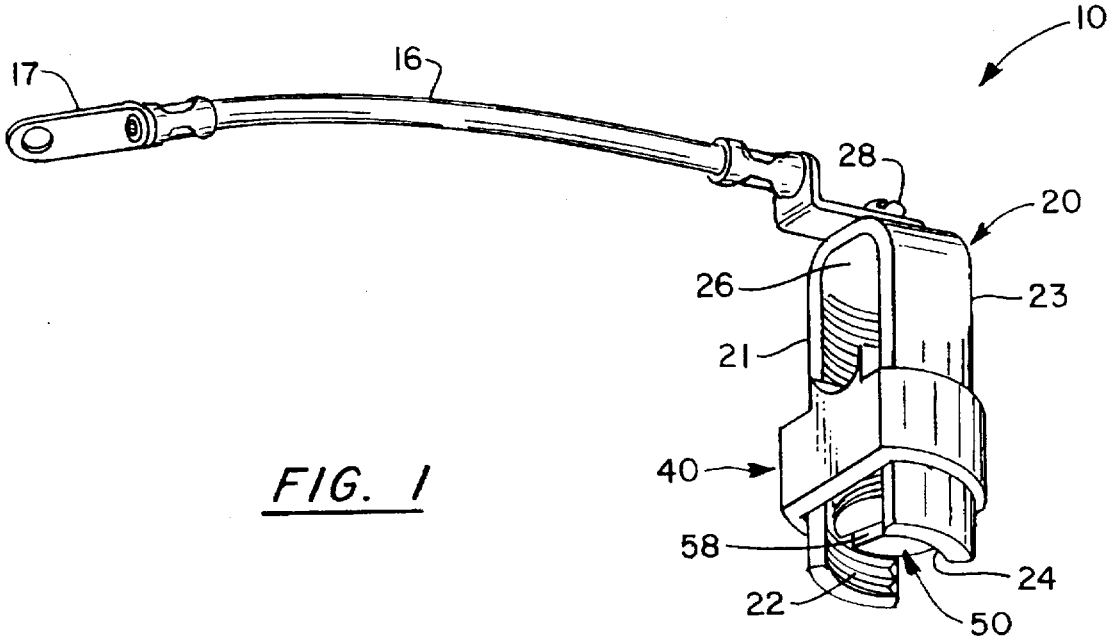
FIG. 1 is a perspective view of a cable shield ground clamp in accordance with the present invention, illustrated in conjunction with a ground wire.

With reference to the drawings wherein like numerals represent like parts throughout the Figures, a cable shield ground clamp in accordance with the present invention is generally designated by the numeral 10. The clamp 10 is particularly adapted for receiving one or more service wires or cables 12 and connecting the tubular metallic shields 14 of the wires to a common ground point. Preferably, the ground connection is provided by a flexible wire 16, or other conventional grounding connector (not illustrated). The cable shield ground clamp 10 is adapted for use in an enclosure, such as a cabinet or other housing, to provide a flexible connection which allows the buried service wire cables and the enclosure to move independently of each other when frost or other environmental forces result in relative disparate displacement.

The cable shield ground clamp 10 comprises a generally U-shaped yoke 20 having generally parallel legs 21 and 23. The legs 21 and 23 of the yoke have respective opposed inwardly disposed thread surfaces 22 and 24. A receiving aperture 26 is generally formed at the upper inward portion of the yoke for receiving one or more service wire ground shields 14. A set screw 28 which may be any of numerous conventional forms, is threaded at the upper cap of the yoke for anchoring the flexible ground wire 16, or other suitable grounding connector (not illustrated). Ground wire 16 is typically a six inch #6 or #10 AWG lead wire and the wire terminal 17 is connected to a ground stud (not illustrated) in the enclosure.

Figure 11:
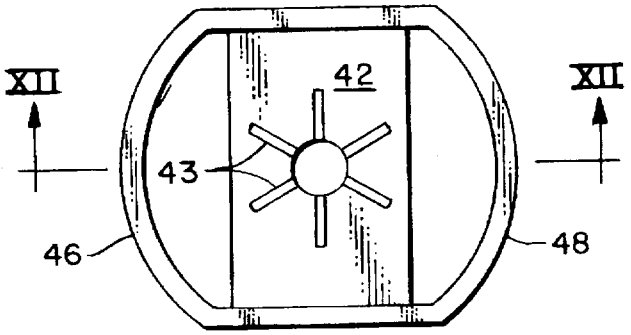
FIG. 11 is a bottom view of a keeper jaw of the ground clamp of FIG. 1.
Figure 12:
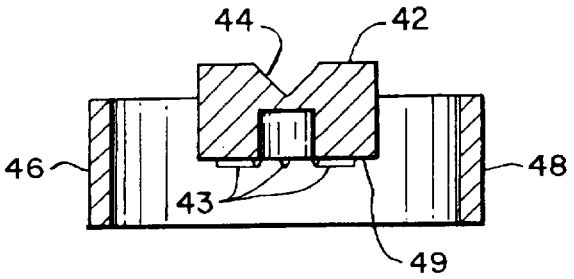
FIG. 12 is a side view, partly in phantom, of the keeper jaw of FIG. 11 taken along line XII—XII thereof.

The ground shields 14 are compressively secured to the clamp by means of a keeper 40 which is slidably displaceable and selectively fixedly positionable along the legs of the yoke. With additional reference to FIGS. 4 and 9–12, the keeper 40 includes an upper clamp jaw 42 which in a preferred form has a laterally extending V-shaped recess or groove 44. The groove 44 enhances surface contact with the ground shield and provides a more intimate clamping engagement. The body of the keeper includes a pair of integral guide skirts 46 and 48. The guide skirts 46 and 48 form axial openings (FIG. 11) which are dimensioned to be greater than the sections of the legs of the yoke to permit sliding displacement relative thereto. The guide skirts 46 and 48 also function to limit lateral separation between the legs of the yoke which are generally parallel regardless of the position of the keeper. The yoke 20 and keeper 40 typically have a tin plated brass composition or a zinc with copper/tin plated composition.

The position and displacement of the keeper 40 is governed by a threaded driver 50. The threaded driver 50 is rotatably mounted at the underside of the clamp jaw 42. The driver 50 has a helical threaded surface which is dimensioned for threading engagement with the complementary thread surfaces 22 and 24 of the yoke. In the illustrated embodiment, the driver 50 includes a knob-like neck 56 (FIGS. 4, 9 and 10) which is inserted into an opening at the underside of the jaw. The jaw sides are then transversely crimped at locations 57*a* and 57*b* to retain the driver with the keeper while allowing the driver to rotate relative to the jaw. Alternate driver mounting means are also possible. The underside of the driver includes a recessed slot 58 which is dimensioned to receive a blade of a screwdriver or similar tool for torquing the driver. The recess walls 59 retain the blade as it rotates. Alternately, the slot 58 may not be recessed. The driver threadably engages the surface 22 and 24 of the yoke and is threadably displaceable along the legs of the yoke for selectively compressively clamping the jaw 42 against a received ground shield 14. The clamp engagement with the ground shield is maintained by the threaded engagement between the driver and the yoke which is also laterally reinforced by the guide skirts 46 and 48.

A surface 52 of the threaded driver 50 engages a surface 49 of the keeper clamp jaw 42 to lock the keeper in the clamped position against the service cable. In a preferred embodiment, the driver surface 52 has a plurality of radially extending grooves 54. The grooves 54 may have a V-shape, a U-shape, or other form. The clamp jaw surface 49 has a complementary number of radially extending projections 43. Alternatively, there may be fewer projections 43 than grooves 54. The projections 43 are received in the grooves 54 when the threaded driver surface 52 engages the keeper clamp jaw surface 49 to resist relative rotational movement therebetween and therefore to lock the keeper in clamped engagement with the service cable. This arrangement increases the ability of the clamp to resist loosening due to vibration or cyclical temperature changes.

The open ended design for clamp 10 allows the keeper 40 to be completely dismounted from the yoke 20 or 21 so that the clamp 10 may be installed onto a wire which is already in service. In addition, the clamp may be disassembled, i.e., the keeper 40 disengaged from the yoke 20, to isolate the ground.

Figure 5:
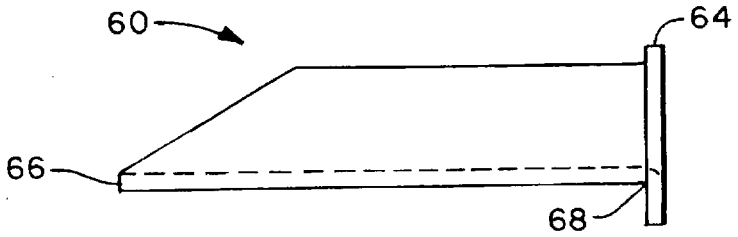
FIG. 5 is a side view, partly in phantom, of the first protective shoe of FIG. 2.
Figure 6:
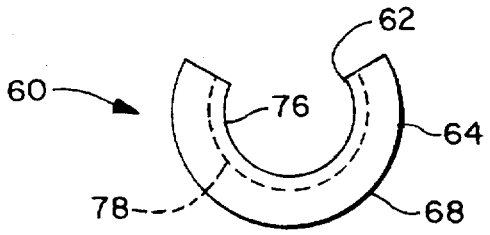
FIG. 6 is a rear view, partly in phantom, of the first protective shoe of FIG. 2.
Figure 7:
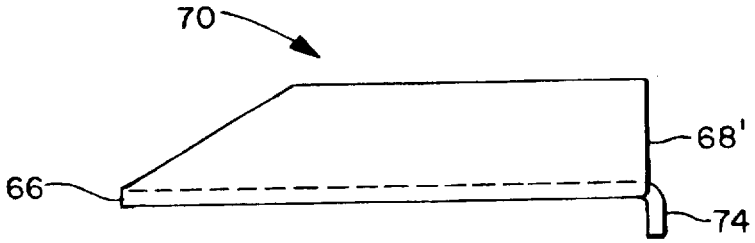
FIG. 7 is a side view, partly in phantom, of the second protective shoe of FIG. 3.
Figure 8:
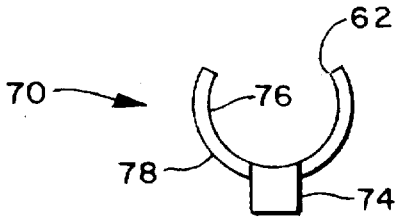
FIG. 8 is a rear view, partly in phantom, of the second protective shoe of FIG. 3.
Figure 9:
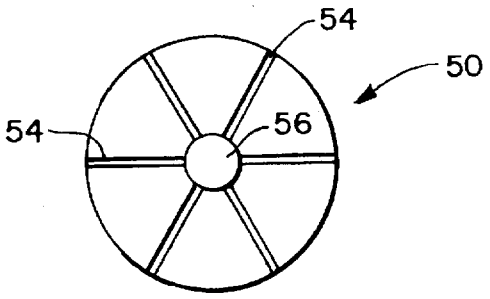
FIG. 9 is a top view of a driver of the ground clamp of FIG. 1.
Figure 10:
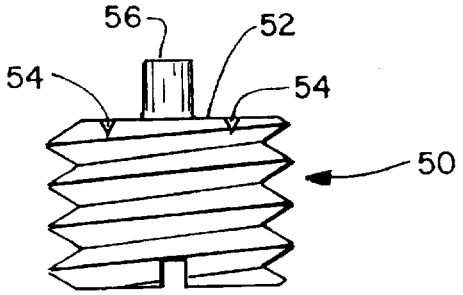
FIG. 10 is a side view of the driver of FIG. 9.

Shielded cables having fine metal conductors or fiber optic conductors can be problematic to ground. The inner conductors are susceptible to crushing when the clamping mechanism is tightened. In one embodiment of the present invention, a protective cap-like shoe 60 (FIGS. 5 and 6) may be inserted in the cable 12 between the conductors 18 and the cable shield 14 to prevent crushing of the conductors 18. In an alternate embodiment, the shoe 70 (FIGS. 7 and 8) may be inserted between the cable shield 14 and the keeper clamp jaw 42. The shoe 60, 70 has an elongated semi-sleeve-like or trough-like member having inner and outer arcuate surfaces 76, 78 and a longitudinally extending channel 62. The channel 62 is sized to allow a cable 12 to be inserted into the shoe 60, 70. A first end 66 of the shoe 60, 70 is tapered to facilitate insertion of the shoe 60, 70 in the cable 12. Generally, the shoe 60, 70 is tapered such that the side of the shoe 60, 70 comprising the channel 62 longitudinally extends a shorter distance than the side opposite the channel 62. The shoe 60 is generally composed of an electrically conductive material and may be used to improve the electrical connection between the ground clamp 10 and the shield 14.

Figure 2:
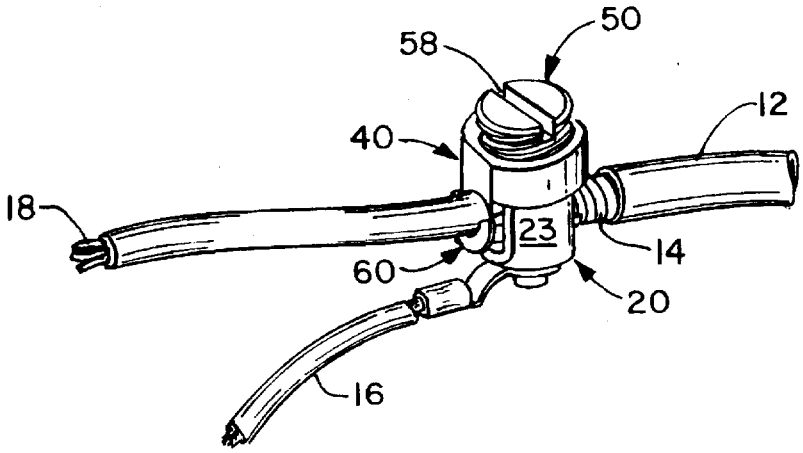
FIG. 2 is a perspective view of the cable shield ground clamp and ground wire of FIG. 1 together with a first protective shoe and a service cable.

In a first embodiment, a radially extending collar 64 extends around a second end 68 of the shoe 60. This shoe 60 is designed to be inserted between the conductors 18 and the shield 14. Such a shoe 60 is used where the shield 14 is to be removed beyond the ground connection, as shown in FIG. 2. The cable 12 is inserted into the shoe 70 through the channel 62. Alternatively, the end of the cable 12 may be threaded through the shoe 60. The tapered first end 66 of the shoe 60 is positioned between the conductors 18 and the shield 14 and the shoe 60 is inserted until the collar 64 abuts the end of the shield 14. The cable 12 and shoe 60 are inserted into the yoke 20 and the guide skirts 46, 48 of the keeper 50. The driver 50 is torqued so that the driver surface 52 engages the cable shield 14, clamping the clamp 10 to the cable 12.

Figure 3:
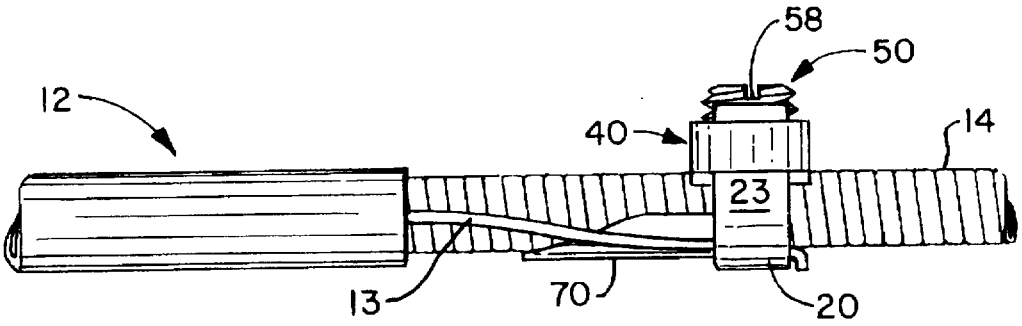
FIG. 3 is a side elevational view of the cable shield ground clamp and ground wire of FIG. 1 together with a second protective shoe and a service cable having at least one strength member.
Figure 4:
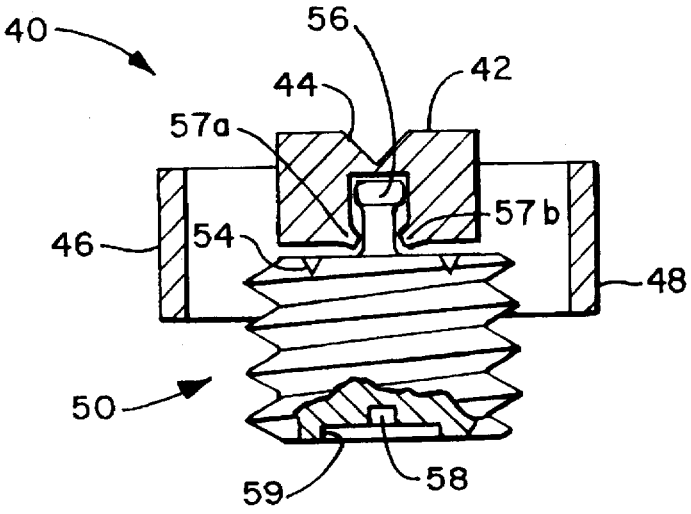
FIG. 4 is a frontal sectional view of the keeper for the cable shield ground clamp of FIG. 1.

In a second embodiment, a single tab 74 radially extends from the second end 68' of the shoe 70. This shoe 70 is designed to be inserted between the shield 14 and the cable strength member 13 of a LXE, OSB or similar cable 12. Such a shoe 70 is used where the shield 14 is to continue beyond the ground connection, as shown in FIG. 3. The cable 12 are inserted into the shoe 70 through the channel 62. The tapered first end 66 of the shoe 70 is positioned between the shield 14 and the strength members 13. The cable 12 and shoe 70 is inserted into the yoke 20 and the guide skirts 46, 48 of the keeper 40. The driver 50 is torqued so that the driver surface 52 engages the shoe 70, clamping the clamp 10 to the cable 12. The strength members 13 are gathered and positioned between the shoe 70 and the yoke 20 to provide additional mechanical strength to the joint.

The ground clamp 10 has particular applicability for buried service wires. The service wires are connected by initially exposing approximately one inch of the ground shield. The service wire and ground shield are inserted into the receiving aperture. The keeper jaw 42 is compressively tightened against the shield upon insertion of a screwdriver blade into the slot 58 and torquing the screwdriver. The legs 21, 23 may have indentations (not shown) that facilitate removal of the distal portions of the legs. The wire terminal 17 of ground wire 16 is then installed onto an appropriate ground stud (not illustrated) within the enclosure. It should be appreciated that a single clamp 10 may be employed to connect either one or several service wires. The connection may be accomplished while also providing a compact configuration.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A conductor protector for a cable having a cable shield ground clamp, the cable having at least one conductor surrounded by a conductive shield, the conductor protector comprising:

an elongated trough-like member having opposite first and second ends and inner and outer arcuate surfaces, said member being composed of electrically conductive material and defining a longitudinally extending channel traversing said inner and outer arcuate surfaces;

means to facilitate insertion of said member into a cable; and means to facilitate the longitudinal positioning of said protector on the cable.

2. The conductor protector of claim 1 wherein said longitudinal positioning means comprises a radially extending collar and wherein said outer surface is engageable with the conductive shield.

3. The conductor protector of claim 1 wherein said longitudinal positioning means comprises a radially extending tab and wherein said inner surface is engageable with the conductive shield.

4. The conductor protector of claim 1 wherein said insertion facilitating means comprises means defining a tapered first end.

5. The conductor protector of claim 1 wherein said channel is sized for receiving the cable.

6. The conductor protector of claim 1 wherein said channel defines a first side of said trough-like member and said trough-like member comprises a second side disposed oppositely said first side, said first and second sides each having a length wherein said length of said second side is greater than said length of said first side.

7. The conductor protector of claim 2 wherein said trough-like member is electrically connectable with the conductive shield.

8. The conductor protector of claim 3 wherein said trough-like member is electrically connectable with the conductive shield.

9. A conductor protector for a cable having at least one conductor surrounded by a conductive shield, the conductor protector comprising:

an elongated trough-like member composed of electrically conductive material, comprising opposite first and second ends and inner and outer arcuate surfaces, said trough-like member defining a longitudinally extending channel traversing said inner and outer surfaces and extending from said first end to said second end, said channel being sized for receiving the cable and defining a first side and an oppositely disposed second side of said trough-like member, said first and second sides each having a length wherein said length of said second side is greater than said length of said first side; and means to facilitate the longitudinal positioning of said protector on the cable comprising a radially extending member.

10. The conductor protector of claim 9 wherein said radially extending member comprises a collar and wherein said outer surface is engageable with the conductive shield.

11. The conductor protector of claim 9 wherein said radially extending member comprises a tab and wherein said inner surface is engageable with the conductive shield.

12. A cable protector assembly comprising:

a cable comprising at least one conductor, an outer jacket, and a conductive shield intermediate said conductor and said jacket; and a conductor protector comprising an elongated trough-like member composed of electrically conductive material having opposite first and second ends and inner and outer arcuate surfaces, said trough-like member defining a longitudinally extending channel traversing said inner and outer surfaces and extending from said first end to said second end, said conductor protector further comprising means to facilitate the longitudinal positioning of said protector on the cable comprising a radially extending member;

wherein said cable is received in said trough-like member through said channel and said conductive shield engages said conductor protector.

13. The conductor protector of claim 12 wherein said conductor protector is inserted between said outer jacket and said conductive shield, whereby said inner surface is engages the conductive shield.

14. The conductor protector of claim 12 wherein said conductor protector is inserted between said conductive shield and said conductor, whereby said outer surface is engages the conductive shield.

* * * * *